US011702332B2

(12) United States Patent
Becher et al.

(10) Patent No.: US 11,702,332 B2
(45) Date of Patent: Jul. 18, 2023

(54) MULTIFUNCTIONAL FILLING VALVE

(71) Applicant: KRONES AG, Neutraubling (DE)

(72) Inventors: Valentin Becher, Neutraubling (DE); Benedikt Hengl, Neutraubling (DE); Josef Doblinger, Neutraubling (DE); Anton Huber, Neutraubling (DE); Hubert Auer, Neutraubling (DE); Stefan Poeschl, Neutraubling (DE)

(73) Assignee: KRONES AG, Neutraubling (DE)

( * ) Notice: Subject to any disclaimer, the term of this patent is extended or adjusted under 35 U.S.C. 154(b) by 431 days.

(21) Appl. No.: 16/926,063

(22) Filed: Jul. 10, 2020

(65) Prior Publication Data

US 2021/0009403 A1 Jan. 14, 2021

(30) Foreign Application Priority Data

Jul. 12, 2019 (DE) ..... 10 2019 118 937.3

(51) Int. Cl.
*B67D 7/02* (2010.01)
*B67D 7/32* (2010.01)

(52) U.S. Cl.
CPC ..... *B67D 7/0294* (2013.01); *B67D 7/3281* (2013.01)

(58) Field of Classification Search
CPC ..... B67C 2003/2671; B67C 3/281; B67C 2003/268; B67C 3/26
See application file for complete search history.

(56) References Cited

U.S. PATENT DOCUMENTS 5,125,441 A * 6/1992 Mette ..... B67C 3/26 141/59
6,698,473 B2 * 3/2004 Decarne ..... B67C 3/281 141/54

(Continued)

FOREIGN PATENT DOCUMENTS

CN 102287065 A 12/2011
CN 103663322 A 3/2014

(Continued)

OTHER PUBLICATIONS

Chinese Office Action dated Sep. 29, 2021 from corresponding Chinese application No. 202010668401.X, 10 pages.

(Continued)

*Primary Examiner* — Timothy P. Kelly
(74) *Attorney, Agent, or Firm* — Haynes and Boone, LLP

(57) ABSTRACT

A filling valve for filling a container with a filling product, e.g., a beverage in a beverage filling system, includes a valve base body. The valve base body includes an outlet configured to discharge the filling product into the container; a swirl chamber configured to receive the filling product and is able to be brought into a fluidic connection with the outlet; and a main inlet, which feeds into the swirl chamber and is configured to introduce at least one main component of the filling product into the swirl chamber such that the filling product is swirled in the swirl chamber, whereby after exiting from the outlet the filling product flows downwardly in a spiral movement in the container. The swirl chamber has an annular shape, the cross-sectional contour thereof having a rounded shape, substantially without corner points, in the direction of extent and perpendicular to the direction of extent.

18 Claims, 9 Drawing Sheets

(56) References Cited

U.S. PATENT DOCUMENTS

| | | | | |
|---|---|---|---|---|
| 2008/0271809 | A1 | 11/2008 | Goldman et al. | |
| 2022/0169488 | A1* | 6/2022 | Becher | B67C 3/284 |

FOREIGN PATENT DOCUMENTS

| | | | |
|---|---|---|---|
| CN | 105229353 | A | 1/2016 |
| CN | 105502256 | A | 4/2016 |
| DE | 7238305 | | 1/1973 |
| DE | 7238305 | U | 1/1973 |
| DE | 26 20 753 | | 11/1977 |
| DE | 40 12 849 | | 10/1991 |
| DE | 4012849 | A1 | 10/1991 |
| DE | 19543945 | A1 | 5/1997 |
| DE | 10 2009 049 583 | | 5/2011 |
| EP | 0453879 | | 10/1991 |
| EP | 0 775 668 | | 5/1997 |
| EP | 2 272 790 | | 1/2011 |
| WO | WO 2009/114121 | | 9/2009 |

OTHER PUBLICATIONS

Extended European Search Report dated Dec. 21, 2020, European Patent Application 20185518.6, 7 pages.
First Office Action dated Feb. 24, 2023 from corresponding European application No. 20 185 518.6, 6 pages.
"Hygienic Design Guidelines," EHEDG Guidelines, Third edition, Mar. 1, 2018, pp. 1-13.

* cited by examiner

MULTIFUNCTIONAL FILLING VALVE

CROSS REFERENCE TO RELATED APPLICATIONS

This application claims priority from German Patent Application No. DE 10 2019 118 937.3, filed on Jul. 12, 2019 in the German Patent and Trademark Office, the disclosure of which is incorporated herein by reference in its entirety.

BACKGROUND

Technical Field

The present invention relates to a filling valve for filling a container with a filling product, for example, a beverage in a beverage filling system.

Related Art

In order to mix and to fill filling products consisting of a plurality of components, various technologies for metering the individual components are known and are set forth briefly hereinafter:

Thus the desired components may be individually metered and filled, for example, via separate metering stations, as is disclosed for example in US 2008/0271809 A1. The use of separate metering stations for a plurality of components, however, leads to a complex system design and process sequence since the filling of each container is divided between a plurality of separate metering/filling stations at which the container has to be positioned for the duration of the respective metering times. Whilst it is possible, in principle, to meter the plurality of components into the containers via separate lines and discharge openings simultaneously and at a common filling station, this is restricted by the size of the bottle opening and/or container opening.

Alternatively, it is possible to guide the components together in a common filling valve, see for example EP 0 775 668 A1 and WO 2009/114121 A1. In this case, the metering of a component to be added to a base fluid is carried out upstream of the filling valve outlet, wherein the desired quantity may be measured out, for example, by measuring the volume by means of a flowmeter (EP 0 775 668 A1) or by a different volumetric metering technology (WO 2009/114121 A1), namely by means of a metering piston and/or a membrane pump.

High levels of metering accuracy may be achieved by measuring out using a flowmeter. This flowmeter measures the volume to be metered or the mass to be metered and, when a threshold value is reached, closes a shut-off valve in the metering line. Other volumetric metering methods, such as for example the use of pumps or timed/pressurized filling, often have greater instability and tend to react more sensitively to changes in the metering medium, for example to changes in the pressure, temperature or composition. This results in frequent calibration, in particular when changing the metering medium. It is almost impossible to implement a gravimetric measurement of the metered amounts due to significant differences between the metering weight, in the case of tiny quantities (μl), and the container weight.

The technologies set forth above are characterized in that the components are mixed at a later time, i.e. either during or shortly before the filling process. An advantage of the later addition of components in contrast to the industrial mixing of large quantities, which is also the conventional method, and later filling, is that it is possible to avoid a migration of concentrated flavourings which, for example, migrate into seals and may not be completely removed from the seals by cleaning. If the components are transported separately from one another to the container opening and the metered amount remains drip-free, a migration of components and/or the flavourings thereof may be substantially eliminated.

The late mixing, however, is also associated with technical difficulties. Thus an optimization of the duration of the filling process is not possible in a simple manner since the metering process may not be accelerated as desired, for example, by using a flowmeter. The time during which the container remains below the metering point is directly proportional to the output of the filling line. With a greater output requirement, therefore, either the metering time and thus the metering region has to be reduced or a second parallel metering line has to be constructed. The potential metering region is dependent on the metering time which is available and thus on the line output.

It should be added that the later mixing is associated with a structural complexity which is not inconsiderable. In the case of small container openings, it is only possible with difficulty to fill a moving container with a stationary metering head. Thus either the metering head has to move with the container (for example as a carousel-type machine) or the container has to stop under the metering head for the metering and filling process, such as for example in the case of a linear cycle machine. If a plurality of different metered components are intended to be provided at the same time, both solutions are complex in terms of engineering technology, cost-intensive and maintenance-intensive and require a large amount of constructional space, due to the plurality of filling points and/or metered components on the filling valve.

Those metering techniques which determine the volume and convey the medium at the same time, namely by means of pumps or piston metering pumps, have the drawback that it is not possible to provide any feedback to the controller about the volume specifically introduced into the container. This applies equally to timed/pressurized filling. If a valve is not opened or the line is blocked, this may not be immediately identified by the system in a simple manner. Since a subsequent quality control of the filled container is not able to be implemented in the case of customized filling with a plurality of components, or only in a very complex manner, feedback from the metering system about the specifically metered quantity is desirable, if not necessarily required.

The above-described technical problems have led to a development of the metering/filling process which is disclosed, for example, in EP 2 272 790 A1 and DE 10 2009 049 583 A1. In this case, directly during the filling process the components of the filling product are metered by means of a flowmeter and introduced together into the container to be filled, wherein during the metering process a main component is displaced to the rear by the metered component. The displaced volume of the main component is determined by means of the flowmeter and thus the volume of the metered component is also known and controllable. During the subsequent filling of the filling product into the container, the main component together with the metered component is thoroughly flushed out of the filling valve into the container, wherein at the same time the total filling quantity may be determined using the same flowmeter. During the next filling cycle, the filling quantities and also the metered component quantities may be determined again. Thus a highly flexible filling of customized beverages is possible without changeover times.

It is known to swirl the fluid to be filled, so that this fluid flows downwardly under the action of the centrifugal force in a spiral movement on the container wall. Any gas which is located in the container and which is displaced during the filling process by the filling product, is able to escape centrally through the container opening. In this manner, a uniform, steady and uninterrupted filling may be implemented with short filling times. For generating the swirl, the filling valve may be provided with swirl bodies which, for example, may be implemented in the form of guide blades or swirl ducts, as disclosed for example in DE 40 12 849 A1 and DE 26 20 753 A1.

Filling valves with swirl bodies, however, have a drawback that it is only possible to remove migrated filling product, in particular any metered components, with difficulty. So that no residues remain in the filling valve which could contaminate the filling product in the subsequent filling process, the quantity and filling of the main component has to be designed such that residues of the previous filling are entirely removed thereby from the filling valve. The swirl generation, however, counteracts such a thorough cleaning. This is because, firstly, residues are able to collect on the swirl bodies; secondly, a laminar flow is generated by the swirling. However, in laminar flows it is almost impossible for transverse mixing to take place, which could be important for thorough flushing out. It should be added that the swirling laminar flow in the filling valve flows through an annular gap with a relatively high specific surface area.

A further technical problem in the above-described swirl valves is that these swirl valves do not provide a stepless control function of the flow rate and thus are not suitable for the high output filling machines which are currently available, in particular with flexible metering by displacement to the rear. For such a control of the flow rate and/or filling speed, currently a proportional flow regulator, PFR, is used upstream of the shut-off valve. The use of two control members in series—shut-off and flow control—is complex in terms of construction and increases the pressure loss. Currently, a wide variety of different types of filling valve exists for different application purposes (carbonated or still filling products, with or without pieces, glass containers or PET containers, etc.) This leads to significant effort in terms of care and maintenance and many machine variants.

SUMMARY

An improved filling valve, in particular to improve the hygienic properties in the case of frequent product change, with a compact and reliable design, is described herein according to various embodiments.

The filling valve is configured for filling a container with a filling product, for example, a beverage in a beverage filling system. The filling product is generally a multi-component filling product made up of a main component and at least one additional component. The main component may be, for example, water or juice; the additional components may include, for example, syrup, pulp, fruit pieces, etc. If the filling product only consists of a main component without additional component(s), then the terms "main component" and "filling product" are used synonymously.

The filling valve has a valve base body with an outlet which is configured to discharge and/or introduce the filling product into the container. During the filling process, the container opening is normally located directly below the outlet. To this end, the container opening may bear against an opening portion of the valve base body. Alternatively, the filling valve is also able to be used as an open-jet valve.

The valve body includes a swirl chamber which is configured to receive the filling product and which is able to be brought into a fluidic connection with the outlet.

The valve base body also includes a main inlet which feeds into the swirl chamber and which is configured to introduce at least one main component of the filling product into the swirl chamber such that the filling product is swirled in the swirl chamber.

The swirl chamber has an annular shape, the cross-sectional contour thereof having a rounded shape, for example substantially without corner points, in the direction of extent and perpendicular to the direction of extent.

In other words, the swirl chamber wall is substantially continuous and differentiable geometrically, both along the annular axis thereof and perpendicular thereto. The term "substantially" firstly refers to the fact that corners are not always avoidable, for example in the opening regions of the main inlet and in any secondary inlets described further below, and secondly that geometric terms such as "continuous", "differentiable" "corner points" etc. are not to be interpreted as ideal mathematical terms. It is important that the cited cross-sectional contours of the swirl chambers do not have a polygonal, namely rectangular, shape.

It should be mentioned that the spatial terms, such as for example "under", "below", "over", "above", etc. refer to the installed position of the filling valve which is clearly determined by the direction of gravity. In the installed state, the axial direction thereof coincides at least substantially with the direction of gravity.

The valve base body requires neither swirl bodies, such as for example guide blades or swirl ducts, nor additional flow guides and thus is very hygienic and tolerant relative to different solid/liquid mixtures which, for example, contain fruit pieces, slurry, fruit fibres, or the like. Moreover, the size of the pieces in the flow is barely restricted by the lack of swirl bodies. The valve base body permits a thorough flushing out of the valve interior with a minimal quantity of flushing fluid, due to the high turbulence which may be achieved in the swirl chamber and a relatively small surface area. Additionally, the swirl chamber has substantially no corners in which flavourings, fruit pieces and the like could collect. The capacity for flushing is also optimized thereby. For these reasons, the valve base body is particularly suitable for the flexible changing of filling product, including the container, in particular by the additional components to be metered.

Since the filling valve with the valve base body is able to be used both for wall filling and also for open-jet filling and/or for products to be filled at atmospheric pressure, the number of variants of filling valve for different applications is reduced. Thus the effort in terms of care and maintenance and the number of machine variants are reduced. Filling systems which are provided with filling valves of the type described herein are able to be used universally. A wide variety of different beverages, container formats and container materials (PET, glass, can, still, carbonated, etc.) may be filled thereby.

In some embodiments, the swirl chamber has the shape of a torus. In this case, the term "torus" denotes not only a rotational body constructed from a circular contour, even if this is typical, but the rotational contour and/or rotational surface may also be elliptical, oval or rounded in a different manner, as long as polygonal corners and edges are not present. Such a rotationally symmetrical construction further assists the formation of a uniform swirl and the capacity for flushing out.

In various embodiments, the main inlet opens tangentially into the swirl chamber. In this case, the term "tangential" does not require a geometrically perfect tangential connection of the main inlet. Instead it may be structurally expedient to permit the main inlet to open at a specific angle into the swirl chamber. It is important that the inflow direction in this case is substantially lateral, i.e. not from above, and thus immediately leads to a swirl, i.e. annular flow, in the swirl chamber.

By the tangential inflow of the filling product from the main inlet into the swirl chamber this filling product is optimally swirled, whereby the filling product is forced outwardly due to centrifugal force and after exiting from the outlet flows downwardly in a spiral movement in the container, generally on the container wall. The tapering and/or constriction of the swirl chamber toward the outlet results in a drop in pressure and thus a stabilization of the swirl. Firstly, this results in a uniform, well-defined swirl across the periphery and, secondly, this is a significant determining factor for the flow rate. The lateral, i.e. tangential, main inlet feeding into the swirl chamber additionally provides space above the swirl chamber. The space is unobstructed and may be used in order to widen the valve base body in a modular manner so that the formation of variants and/or differentiation of the filling valve for specific applications may be carried out later, whereby costs and resources may be saved. The compact design of the valve base body permits, for example, a hygienic integration of a valve cone drive for the flow control and/or optionally further control functions (gas valve(s) for prestressing the containers, return gas line(s), depressurizing line(s), solenoid valve(s), etc.) above the valve base body. For example, a control circuit board for implementing decentralized control architectures may also be installed in a valve head above the valve base body.

In several embodiments, at least the axial outer wall of the swirl chamber transitions in a continuous and differentiable manner into the main inlet in order to optimize the swirl formation and the capacity for flushing out. For the same reasons, the main inlet in the region of the opening into the swirl chamber generally has substantially the same cross-sectional contour perpendicular to the direction of extent as the swirl chamber. In various embodiments, both contours are circular with substantially the same diameter. In this manner, the tangential supply of filling product optimally transitions into the annular flow inside the swirl chamber.

In some embodiments, the outlet is annular, wherein the similarly annular swirl chamber gradually tapers toward the outlet, whereby after exiting from the outlet the filling product flows downwardly in a spiral movement in the container. By means of a targeted acceleration of the filling product in the annular duct a rapid and controlled filling may be implemented between the swirl chamber and the outlet. The swirl chamber typically has a shape which is axially symmetrical to the axis of the annular outlet.

In certain embodiments, the filling valve has a valve cone which is generally at least partially produced from Teflon and/or generally configured to be adjustable. The potential adjustability of the valve cone may include a shut-off function and/or flow control as set forth hereinafter.

Thus the valve base body typically includes a valve cone which is configured for flow control of the filling product through the outlet in an adjustable manner. The term "flow control" is understood herein as an alteration to the flow by adjusting the valve cone, without a complete elimination of the flow, i.e. a flow of zero, being encompassed thereby. A binary switching on and off of the flow thus does not come under the scope of flow control. The adjustability of the valve cone is generally carried out in a translatory manner in the axial direction determined by the outlet. The valve cone itself also typically extends in the axial direction. In various, the valve cone is steplessly adjustable within a working path.

The valve cone assists the swirl formation. For filling large pieces, for example having volumes of 5×5×5 mm or more, the valve cone travel during the filling process may be increased in a flexible manner, whereby the adjustability of the valve cone may serve not only for controlling the filling speed but also broadens the range of filling products which are able to be filled.

If the valve cone is produced from Teflon, the outflow behaviour may be improved due to the low surface energy. If additionally a valve cone made of Teflon is combined with a valve housing made of stainless steel, a complete seal may be ensured by such a material pairing, even in the case of high pressure differences, provided the filling valve provides a shut-off function. Teflon also has a very good resistance relative to a potential migration of flavourings.

In several embodiments, the valve base body includes a valve seat, wherein the valve cone and the valve seat are configured such that in a shut-off position the valve cone is sealingly in contact with the valve seat for completely sealing the outlet. The integration of the flow control function and shut-off function in the valve base body permits a reduction in the number of components and a simplification of the product path. This leads to fewer pressure losses and contributes to a more careful product handling and reduced foam formation during the filling process.

In certain embodiments, the filling valve has a control valve which is connected upstream of the valve base body, whereby pressure surges at the start of the filling process are absorbed and the narrowing of the product flow toward the filling end is improved and the swirl may be reliably maintained.

In various embodiments, the valve cone has a conical outlet contour which tapers toward the outlet and extends at least partially into the swirl chamber. In this manner, the design of the valve base body is particularly compact.

The swirl chamber generally extends substantially axially symmetrically about the valve cone. In this case, the valve cone penetrates the swirl chamber centrally, whereby the valve cone forms a part of the wall forming the swirl chamber in a synergistic manner. In this manner, the valve base body may be designed to be even more compact, wherein the functionalities of the valve cone and the swirl chamber are structurally integrated.

In several embodiments, the valve base body includes one or more secondary inlets which open into the swirl chamber and which are correspondingly configured to introduce one or more additional components of the filling product into the swirl chamber, such that these additional components are mixed therein with the main component. The mixing-in of any additional components is carried out directly in the swirl chamber through the secondary inlets, whereby a capacity for effective flushing out of the valve base body is ensured and a potential migration of flavourings is minimized. Additionally, the filling valve is thus particularly suitable for applications in filling systems which are designed for a flexible metering and instant product change by displacement to the rear.

The filling product in this case is mixed together from a plurality of components, a main component, such as for example water or juice, and at least one additional component, such as for example syrup, directly in the swirl chamber of the filling valve. In this case, during the filling process, the additional components of the filling product are introduced into the swirl chamber and passed together into the container to be filled by swirling. By the introduction of the additional components into the swirl chamber the main component, which was previously supplied through the main inlet, is displaced to the rear. The displaced volume of the main component is determined, for example, by means of a flowmeter and thus the volume of the metered component(s) is also known and controllable. During the subsequent filling of the filling product into the container, the main component together with the metered components are completely flushed out of the filling valve into the container, wherein at the same time the total filling quantity may be determined using the same flowmeter. During the next filling cycle, the filling quantities and also the metered component quantities may be determined again. Thus a highly flexible and hygienic filling of customized beverages is possible, substantially without changeover times.

In some embodiments, the valve base body includes a valve housing which forms at least a part of the wall defining the swirl chamber and the outlet, whereby the valve base body is structurally simplified and particularly reliable. The valve housing may be produced integrally. In an exemplary embodiment, the valve housing is a cast body.

In certain embodiments, at least one of the secondary inlets is configured by apertures in the valve housing. By integrating the supply of metered components into the valve housing, no hoses or additional lines are required. In this manner, in a structurally simple and reliable manner the capacity for flushing out the valve base body is optimized and the potential migration of flavourings is minimized.

In various embodiments, the valve base body includes a membrane made of a deformable material, for example Teflon, which forms a part of the wall defining the swirl chamber, generally in the upper region. The membrane is connected to the valve housing on an outer contour which is generally circular, and to the valve cone, if present, on an inner contour which is generally also circular. The lateral, i.e. tangential, main inlet opening into the swirl chamber provides, in addition to the aforementioned technical effects, space above the swirl chamber which may be used for mounting a membrane which seals the swirl chamber in the upper region.

The membrane is produced from a deformable and/or flexible material, whereby it is able to follow the axial movement of the valve cone and at the same time ensures a hygienic seal. The working region of the valve cone at the same time determines the degree of deformability which the material has to provide to the membrane. By this functionality the terms "flexible" and "deformable", etc. are defined relative to the membrane. The flexibility of the membrane and the nature of the material, in particular in the case of Teflon, additionally assist a filling of the filling product by swirling, even in the case of very small filling streams. An unintended local maximum flow at the start of the filling process, before a uniform flow is set by swirling, may be counteracted by adjusting the valve cone and/or by a control valve located upstream.

The symmetry of the membrane additionally permits a design with a high load cycle as is generally required for filling valves. In some embodiments, the membrane has an annular clamping portion which is configured for fastening to the valve housing.

In several embodiments, the valve housing includes one or more interfaces on the outer face remote from the swirl chamber for respectively connecting a line or a metering valve, whereby the filling valve is able to be extended in a modular manner. By connecting the metering valves any additional components may be accurately metered-in, in particular in the case of using flexible metering by displacement to the rear.

In some embodiments, the valve base body includes a gas duct which penetrates the valve cone in the axial direction, wherein the gas duct typically provides separate gas paths via a pipe-in-pipe construction. The gas duct may be used as a return gas duct in order to divert a gaseous atmosphere in the container, which is displaced from the container during filling. The gas duct, however, may also have a multi-duct construction in order to provide separate supply and exhaust gas paths, for example in order to evacuate the container to be filled, to prestress the container with a prestressing gas, namely carbon dioxide, to flush the container, to clean the container, etc.

In several embodiments, the filling valve includes a valve cone drive which is mechanically connected to a connecting portion of the valve cone and which is configured to actuate the valve cone, generally electromotively, magnetically, pneumatically or hydraulically, wherein the valve cone drive typically a spring for prestressing the valve cone into a working position, generally the shut-off position. The compact design of the valve base body permits a hygienic, reliable and structurally simple integration of the valve cone drive.

In certain embodiments, the filling valve includes a valve central part which is connected to the valve base body, and a valve head part which is connected to the valve central part, wherein the valve central part includes the valve cone drive. The tangential main inlet set forth above leaves the upper face of the valve base body unobstructed such that one or more valve components may be attached in a stacked manner, whereby the filling valve is able to be constructed in a modular manner and the forming of variants and/or differentiation for the specific application is able to be carried out later. In this manner, the effort in terms of care and/or maintenance and the number of machine variants are reduced.

In various embodiments, the valve head part includes one or more supply connections which are in a fluidic communication with the gas duct and which in each case provide an inlet and/or outlet for gas, whereby the filling valve is able to be used in a flexible manner and may be easily installed and maintained by the easily accessible supply connections on the valve head part.

In some embodiments, the valve head part includes one or more gas valve interfaces for connecting one respective gas valve, wherein the filling valve is able to be constructed and/or configured in a substantially modular manner and the forming of variants and/or differentiation for the specific application is able to be carried out later.

In several embodiments, the filling valve includes a rod-shaped level probe which is able to be inserted through the gas duct and which is configured to protrude in the inserted state into the container and to detect a filling level of the filling product in the container. A corresponding interface with an aperture for mounting the level probe may be configured in the valve head part. In this manner, the filling valve may be extended by measuring technology, within the scope of the modular basic construction.

Further advantages and features of the present invention may be derived from the following description of exemplary embodiments. The features described therein may be implemented individually or in combination with one or more of the features set forth above, insofar as the features do not contradict one another. The following description of exemplary embodiments is made with reference to the accompanying drawings.

BRIEF DESCRIPTION OF THE FIGURES

Further embodiments of the invention are described in more detail by the following description of the figures.

DETAILED DESCRIPTION

Figure 1:
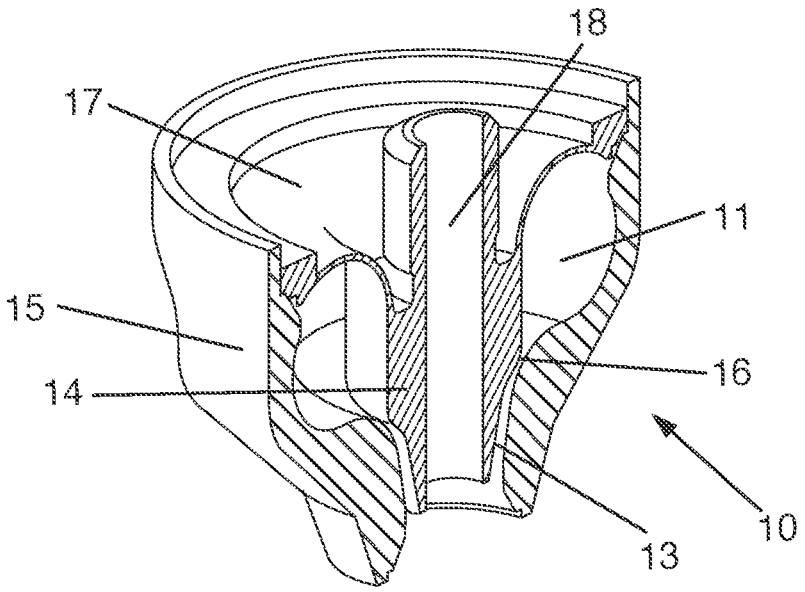
FIG. 1 shows a perspective sectional view of a valve base body with a swirl chamber, valve cone and membrane.

Exemplary embodiments are described hereinafter with reference to the figures. In this case, elements which are the same, similar or similar-acting are provided with identical reference numerals in the figures and a repeated description of these elements is dispensed with in some cases in order to avoid redundancies.

Figure 2:
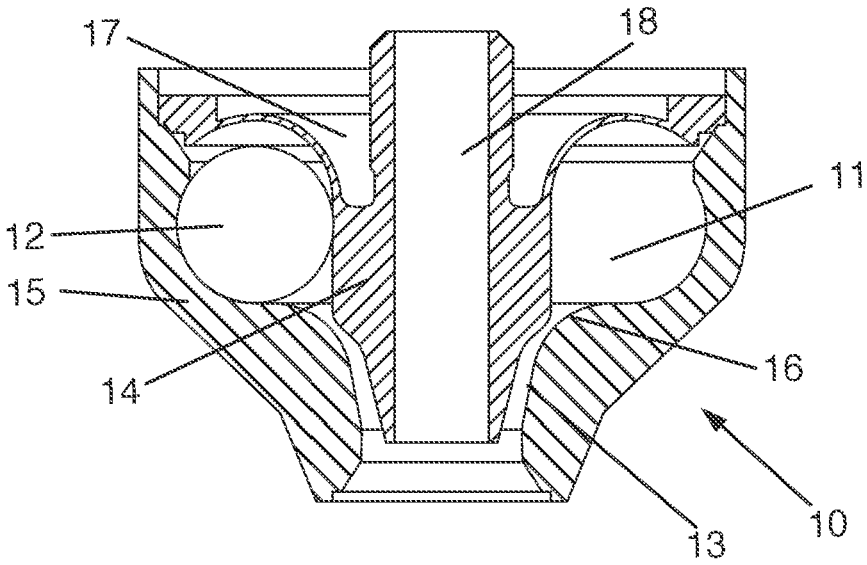
FIG. 2 shows a cross-sectional view of the valve base body of FIG. 1.

FIG. 1 is a perspective view of the valve base body 10 of a filling valve 1 (see FIG. 6) with swirl generation. FIG. 2 shows the valve base body 10 in a cross-sectional view.

The valve base body 10 has a swirl chamber 11 designed as an annular duct and/or torus. The valve base body 10 also has a main inlet 12, not visible in the perspective view in FIG. 1, which opens tangentially or substantially tangentially into the swirl chamber 11. The main inlet 12 is shown schematically in FIG. 2. The main inlet 12 is additionally shown in the exemplary embodiments of FIGS. 2, 3*a*, 3*b* and others.

In the lower region of the valve base body 10 the swirl chamber 11 tapers toward an annular outlet 13 from which the filling product exits during the filling process and runs into a container placed below the valve base body 10 (not shown in FIGS. 1 and 2).

It should be mentioned that the spatial terms such as "under", "below", "over", "above", etc. refer to the installed position of the filling valve 1 which is clearly determined by the direction of gravity. Moreover, by the annular outlet 13 the filling valve 1 and/or the valve base body 10 thereof has a clearly defined axial direction which in the installed state coincides at least substantially with the direction of gravity.

By the tangential supply of filling product from the main inlet 12 into the swirl chamber 11 this filling product is swirled, whereby the filling product is forced outwardly due to centrifugal force and after exiting the valve base body 10 is pushed outwardly and flows downwardly on the container wall. The tapering and/or constriction of the swirl chamber 11 to the outlet 13 firstly leads to a uniform, well-defined swirl across the periphery and secondly is a significant determining factor for the flow rate. Thus if the degree of tapering, in particular the dimension of the annular gap at the outlet 13, is adjustable, an integrated flow control may be implemented, optionally including the shut-off thereof, or the maximum size of the pieces in the filling product may be altered.

The aforementioned flow control may be implemented as follows: according to the exemplary embodiment of FIGS. 1 and 2 the valve base body 10 has to this end a valve cone 14 which has a cylindrical shape tapering toward the outlet 13. The annular gap adjoining the swirl chamber 11 is at least partially formed on the inner face by the outer peripheral surface of the valve cone 14. Externally the annular gap is defined and/or formed by a valve housing 15. The valve cone 14 according to the present exemplary embodiment is designed to be displaceable in the axial direction, i.e. upwardly and downwardly. In this manner, the annular gap may be enlarged and reduced at the outlet 13. The height adjustment of the valve cone 14 is carried out, generally steplessly, within the working region, i.e. between a fully open position and a closed position or a position of minimal flow. If by the internal shape of the valve housing 15 a valve seat 16 is formed which is in sealed contact with the valve cone 14 in a closed position of the filling valve 1, the outlet 13 may be fully closed, whereby a shut-off function is implemented.

The lateral, i.e. tangential, main inlet 12 feeding into the swirl chamber 11 also provides space above the swirl chamber 11, in addition to the aforementioned technical effects. The space is unobstructed and may be used for mounting a membrane 17 which seals the swirl chamber 11 in the upper region. The membrane 17 has a circular outer contour which is connected directly or indirectly via a fastening means to the valve housing 15. The membrane 17 is fastened radially internally to the valve cone 14. The membrane 17 is produced from a flexible material, for example Teflon, whereby it is able to follow the axial movement of the valve cone 14 and at the same time ensures a hygienic seal of the swirl chamber 11. The symmetry of the membrane 17 additionally permits an embodiment with a high load cycle as is generally required for filling valves.

The valve base body 10 also has a gas duct 18 which centrally penetrates the valve cone 14 in the axial direction. The gas duct 18, for example, is a return gas duct in order to divert any gas such as pressurized gas, which is displaced during the filling process out of the container. The gas duct 18, however, may also have a multi-duct construction, for example a pipe-in-pipe construction in order to provide separate supply and exhaust gas paths.

The valve cone 14 terminates substantially directly below a throttle point, i.e. the narrowest point of the annular gap forming the outlet 13, whereby a defined change from a single-phase separated flow to a wall film flow is implemented in the container. Thus a well-defined uniform separation edge of the liquid is formed and namely at the point with the greatest flow rate. In an exemplary embodiment, the valve seat 16, i.e. the shut-off point, is located in the immediate vicinity of the separation edge, whereby the surfaces which could lead to dripping are minimized.

The valve cone 14 is generally produced from Teflon, whereby the outflow behaviour is improved due to the low surface energy. If the valve housing 15 is additionally produced from stainless steel, a full seal may be ensured by such a material pairing, even in the case of high pressure differences.

Apart from the valve cone 14, the valve base body 10 requires neither swirl bodies, such as for example guide blades or swirl ducts, nor additional flow guides and thus is very hygienic and tolerant relative to different solid/liquid mixtures which contain, for example, fruit pieces, slurry, fruit fibres or the like. Moreover, the size of the pieces in the flow is barely restricted due to the lack of swirl bodies. For filling large pieces, for example having volumes of 5×5×5 mm or more, the valve cone travel during the filling process may be increased in a flexible manner.

The valve base body 10 is particularly suitable for the aforementioned wall filling in which the filling product runs downwardly in a spiral-shaped manner on the container wall. However, a filling valve 1 provided with the valve base body 10 may also be used as an open-jet valve. In this case, the valve base body 10 may be used as a hygienic control valve, by said control valve being installed in a corresponding filling product line with an adjoining steadying section and optionally a gas barrier at the outlet. If required, the swirl may be removed through a radial, instead of a tangential, main inlet 12.

The valve base body 10 permits a thorough flushing out of the valve interior, in particular the swirl chamber 11 and the outlet 13 adjoining thereto in the filling direction, with a minimal quantity of flushing fluid, due to the high turbulence which may be achieved in the swirl chamber 11 and a relatively small surface area. For this reason, the valve base body 10 is particularly suitable for a frequent change of filling product, for example including the container, in particular of components to be metered-in. Due to the particularly effective capacity for flushing out, the valve base body 10 may also be used in aseptic filling machines.

The integration of the control and shut-off function in the valve base body 10 permits a reduction in the number of components and a simplification of the product path. This leads to fewer pressure losses and contributes to a more careful product handling and reduced foam formation during the filling process.

The compact design of the valve base body 10 additionally permits a hygienic integration of the valve cone drive and optionally further control functions in the valve head, i.e. above the swirl chamber 11, for example an integration of gas valves for prestressing the containers, return gas lines, depressurizing lines, solenoid valves for further separate control functions in the region of the filling valve 1, such as lifting and lowering the valve, metering-in components, etc. Similarly, for example, a control circuit board for implementing non-central control architectures may be installed in the valve head.

Since the filling valve 1 with the valve base body 10 is able to be extended in a modular manner and is also able to be used both for wall filling and for open-jet filling and/or for products to be filled at atmospheric pressure, the plurality of variants of filling valve for different uses is reduced. Thus the effort in terms of care and maintenance and the number of machine variants are reduced. Filling systems which are provided with filling valves 1 of the type described herein are able to be used universally. A wide variety of different beverages, container formats and materials (PET, glass, can, still, carbonated, etc.) may be filled thereby.

Figure 3A:
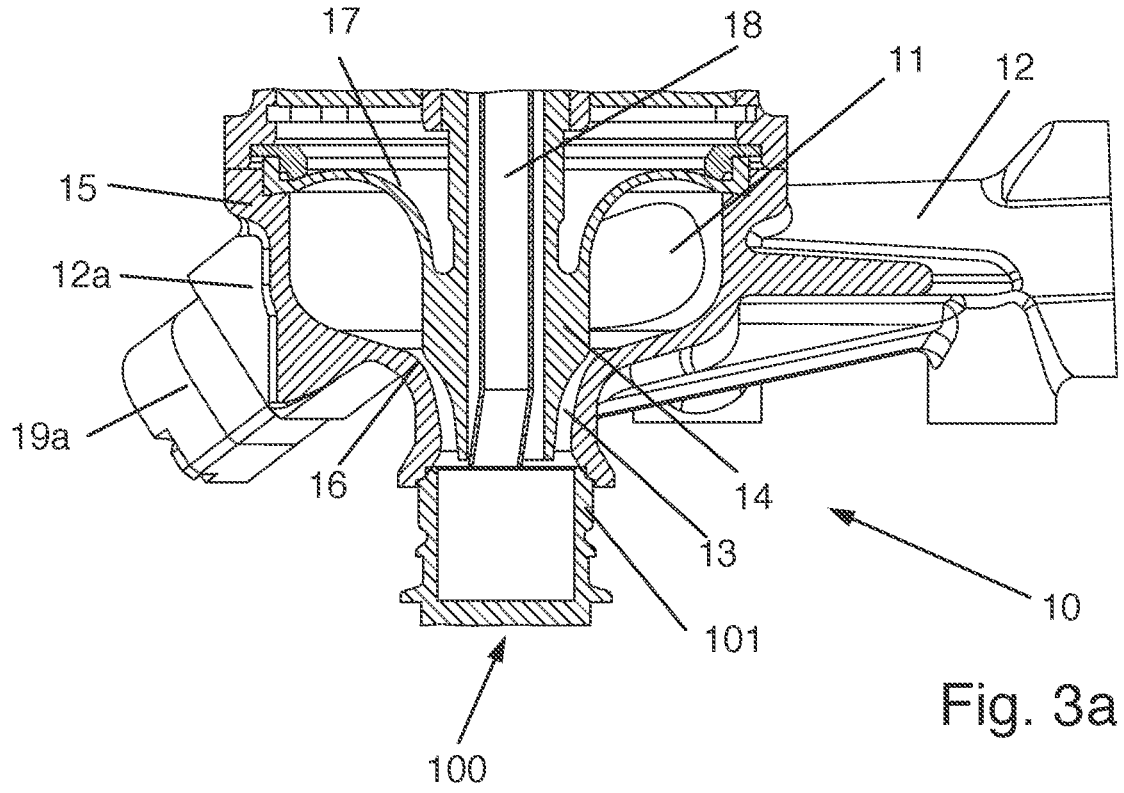
FIG. 3*a* shows a cross-sectional view of a valve base body with a swirl chamber, valve cone and membrane according to a further exemplary embodiment.
Figure 3B:
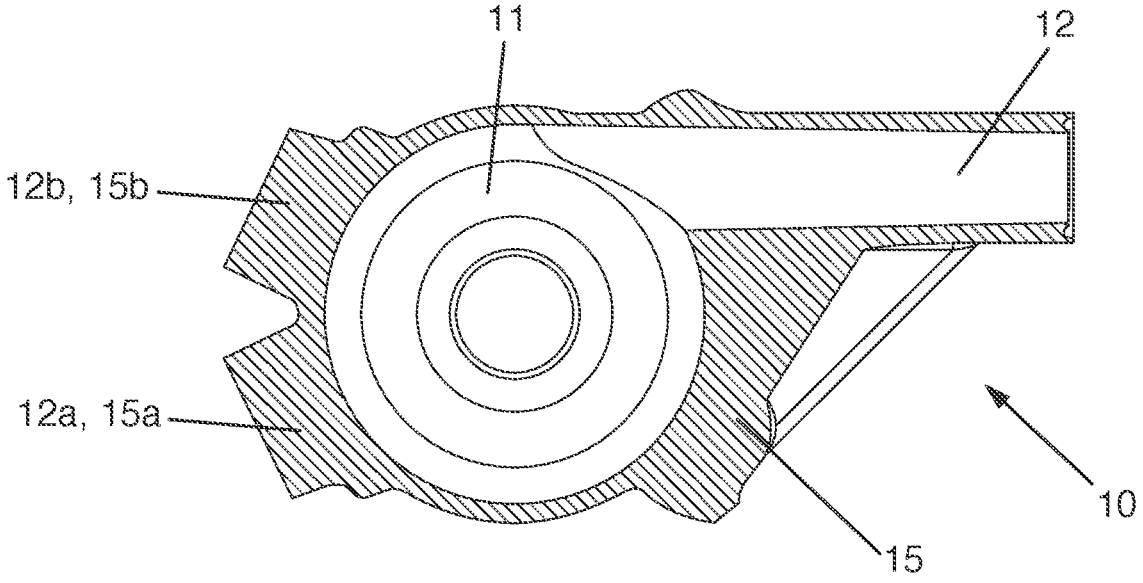
FIG. 3*b* shows the valve base body of FIG. 3*a* in a plan view.

FIG. 3*a* is a cross-sectional view of a valve base body 10 with swirl generation according to a further exemplary embodiment. A plan view of the valve base body 10 is shown in FIG. 3*b*. The basic construction and the technical functions associated therewith are similar to the exemplary embodiment of FIGS. 1 and 2. The valve base body 10 according to FIGS. 3*a* and 3*b*, however, has a functional scope which is extended relative to the above-described variants.

Thus the valve base body 10 has two further inlets which are denoted herein as the first and second secondary inlets 12*a*, 12*b*. The number of two secondary inlets is only by way of example and may be varied according to the purpose of the application.

The secondary inlets 12*a*, 12*b* permit the supply of further components, which are also denoted herein as additional component(s), directly into the swirl chamber 11. In order to be able to meter the quantities of additional components, the secondary inlets 12*a*, 12*b* are provided in each case with a metering valve 19*a*, 19*b*. The metering valve 19*b* is not visible in the perspective view of FIG. 3*a* but may be derived, for example, from FIG. 7*a*. The metering valves 19*a*, 19*b* permit, in particular, metering by displacement to the rear, as is described in detail below. Initially, however, further structural particularities and embodiments of the valve base body 10 will be described.

Through the secondary inlets 12*a*, 12*b* the mixing-in of additional components takes place directly in the swirl chamber 11, whereby an effective capacity for flushing out the valve base body 10 is ensured and any potential migration of flavourings is minimized. Due to the integration of the supply of metered components into the valve housing 15, no hoses or additional lines are required. In this manner, the valve base body 10 is particularly suitable for an instant change of product.

Figure 4:
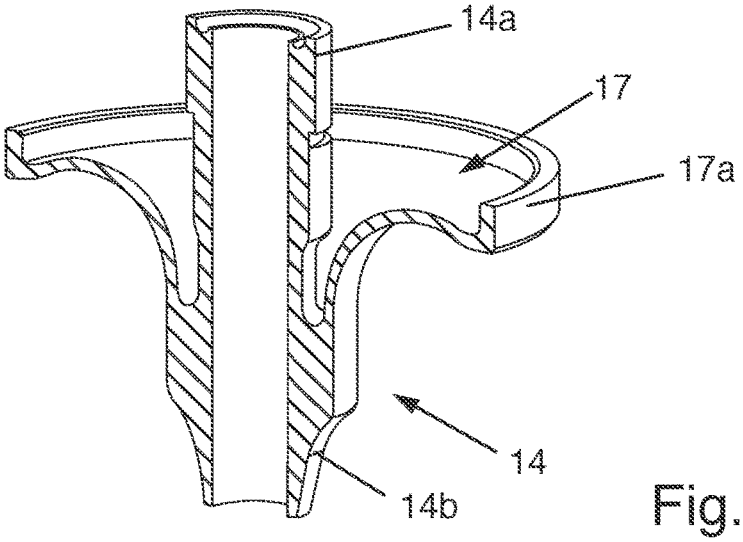
FIG. 4 shows a perspective sectional view of a structural unit consisting of the valve cone and membrane of the valve base body of FIGS. 3*a* and 3*b;*

The valve base body 10 is in many respects of modular construction and thus may be functionally extended and adapted in a simple manner. Thus in FIG. 4 a structural unit consisting of the valve cone 14 and the membrane 17 is shown. The membrane 17 has a clamping portion 17*a* which is designed for fastening in the valve housing 15. The clamping portion 17*a* is an annular structure, which as an integral component of the membrane 17 or as separate element may be fastened thereto. In the radially internal region the membrane 17 is fastened to the valve cone 14. Located in the upper region of the valve cone 14 is a connecting portion 14*a* for connecting to a potential valve cone drive.

A material pairing of Teflon for the valve cone 14 and for the membrane 17 may be present in some embodiments. The flexibility of the membrane and the nature of the material assist a filling of the filling product by swirling, even with very small filling streams. Additionally, an unintended local maximum flow at the start of a filling process, before a uniform flow is set with swirling, is counteracted. In combination with a valve cone 14 made of Teflon which optimizes the outflow behaviour due to low surface energy, therefore, a uniform, steady and uninterrupted filling may be implemented with short filling times.

Since the clamping portion 17*a* and the connecting portion 14*a* have defined, for example standardized, dimensions, different membranes 17 and/or valve cones 14 with different flow properties and filling properties may be used without the entire valve base body 10 having to be redesigned. The remaining valve base body 10, in particular the valve housing 15, may be a fixed, standardized component, whilst the valve properties are easily variable by the structural unit consisting of the valve cone 14 and membrane 17. In this manner, for example, the size of the swirl chamber 11, the shape of the valve cone 14, in particular the outlet contour 14*b* thereof, the prestressing position and the prestressing force of the valve cone 14 may be modified by the membrane 17, and the like, in a simple manner and adapted to the desired application environment.

In a similar manner, the valve base body 10, in particular the valve housing 15, may also be designed in a modular manner. Thus FIG. 5 shows in a perspective view the valve housing 15 as a modular unit of the valve base body 10 according to an exemplary embodiment.

Figure 5:
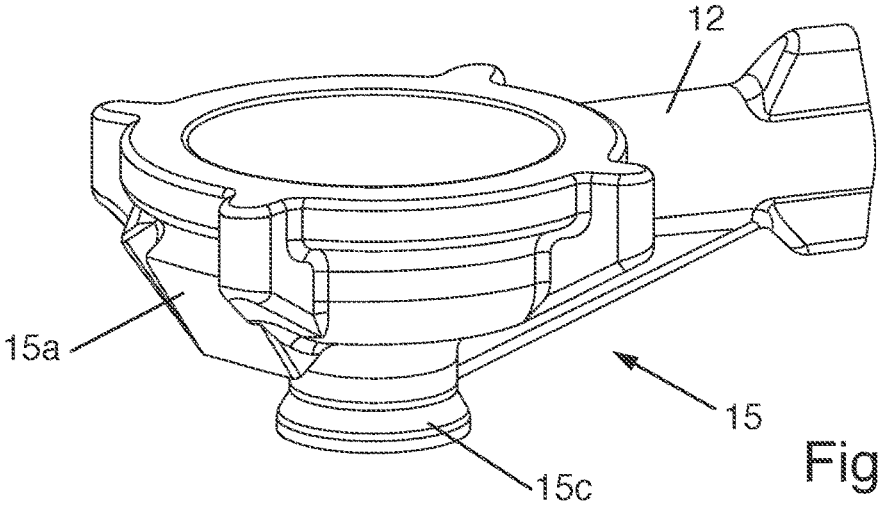
FIG. 5 shows a perspective view of the valve housing as a modular component of the valve base body of FIGS. 3*a* and 3*b;*

The valve housing 15 is shown in FIG. 5 in a basic shape. This is generally designed as a cast body with uniform interfaces. The valve housing 15 in the basic shape serves as an initial component for various production variants which may relate, for example, to variants of the opening portion 15*c* for connecting to the container to be filled or the shape and number of interfaces 15*a*, 15*b* for any secondary inlets 12*a*, 12*b*.

Figure 5A:
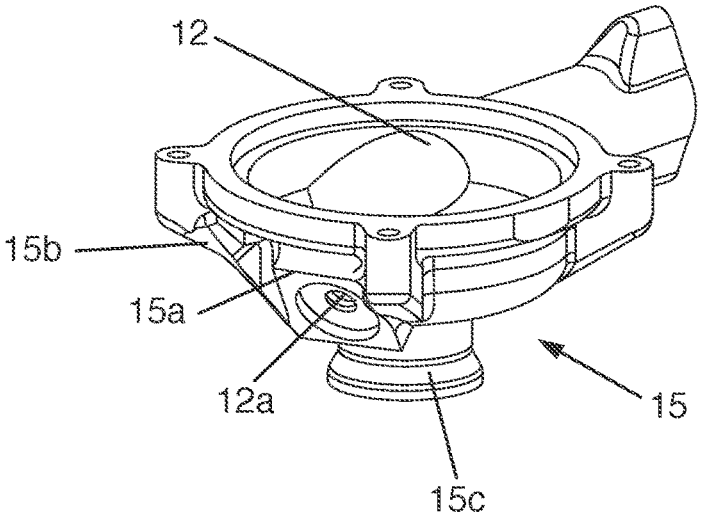
FIGS. 5*a* to 5*d* show perspective views of different configurations of the valve housing of FIG. 5.
Figure 5B:
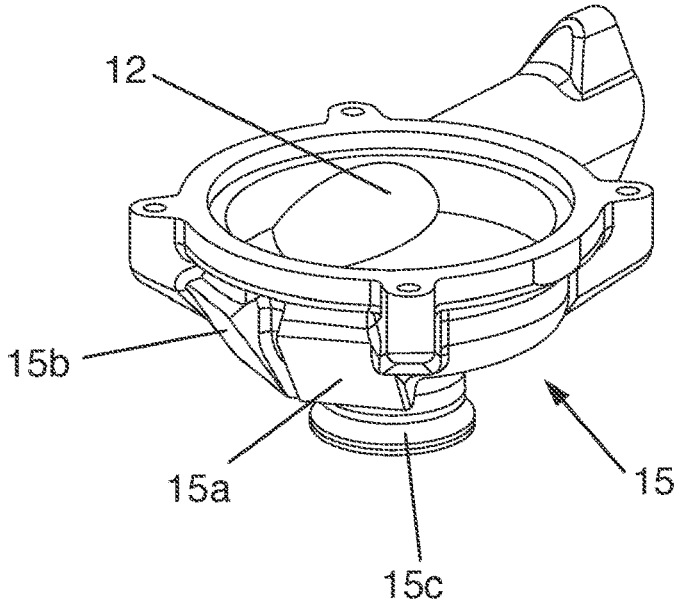
Figure 5C:
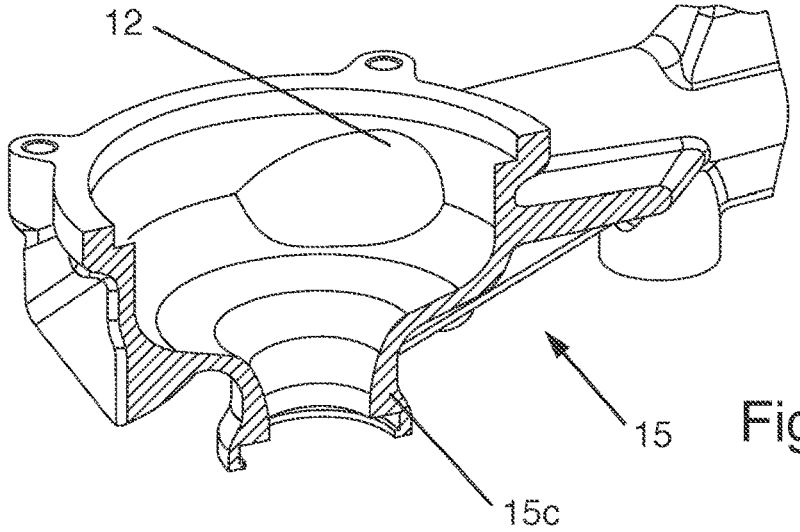
Figure 5D:
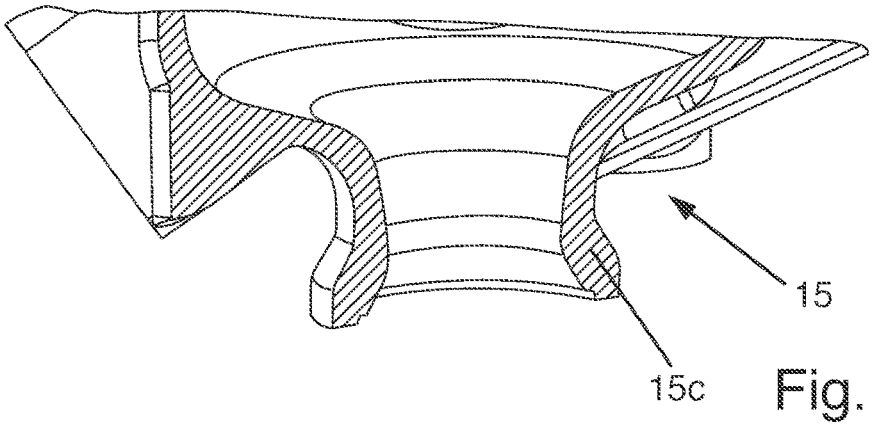

FIGS. 5*a* to 5*d* show different embodiments of the valve housing 15 in order to satisfy different application environments. Thus FIG. 5*a* shows a variant in which the secondary inlets 12*a* and 12*b* are open. Thus lines, metering valves 19*a*, 19*b* or the like may be connected to the interfaces 15*a*, 15*b* located at that point, in order to be able to introduce and/or meter components of the filling product, such as for example syrup, pulp, slurry, pieces, etc. into the swirl chamber 11. FIG. 5*b* shows the basic shape of the valve base body 10 in the production variant with the secondary inlets closed or not implemented. The interfaces 15*a*, 15*b* or basic shapes thereof, not further differentiated, are visible. FIG. 5*c* shows the valve housing 15 with an opening portion 15*c* which is designed for receiving bottle openings and/or for filling glass bottles. FIG. 5*d* shows the valve housing 15 with an opening portion 15*c* which is designed for receiving bottle openings and/or for filling PET bottles.

Returning to FIG. 3*a* a possible connection of a bottle-shaped container 100 to the opening portion 15*c* of the valve housing 15 is shown therein. The container 100 has a container opening 101 which in the wall filling mode is in contact with the opening portion 15*c*, whereby during the filling process the filling product swirled through the swirl chamber 11 flows downwardly under the action of the centrifugal force in a spiral movement on the container wall.

Figure 6:
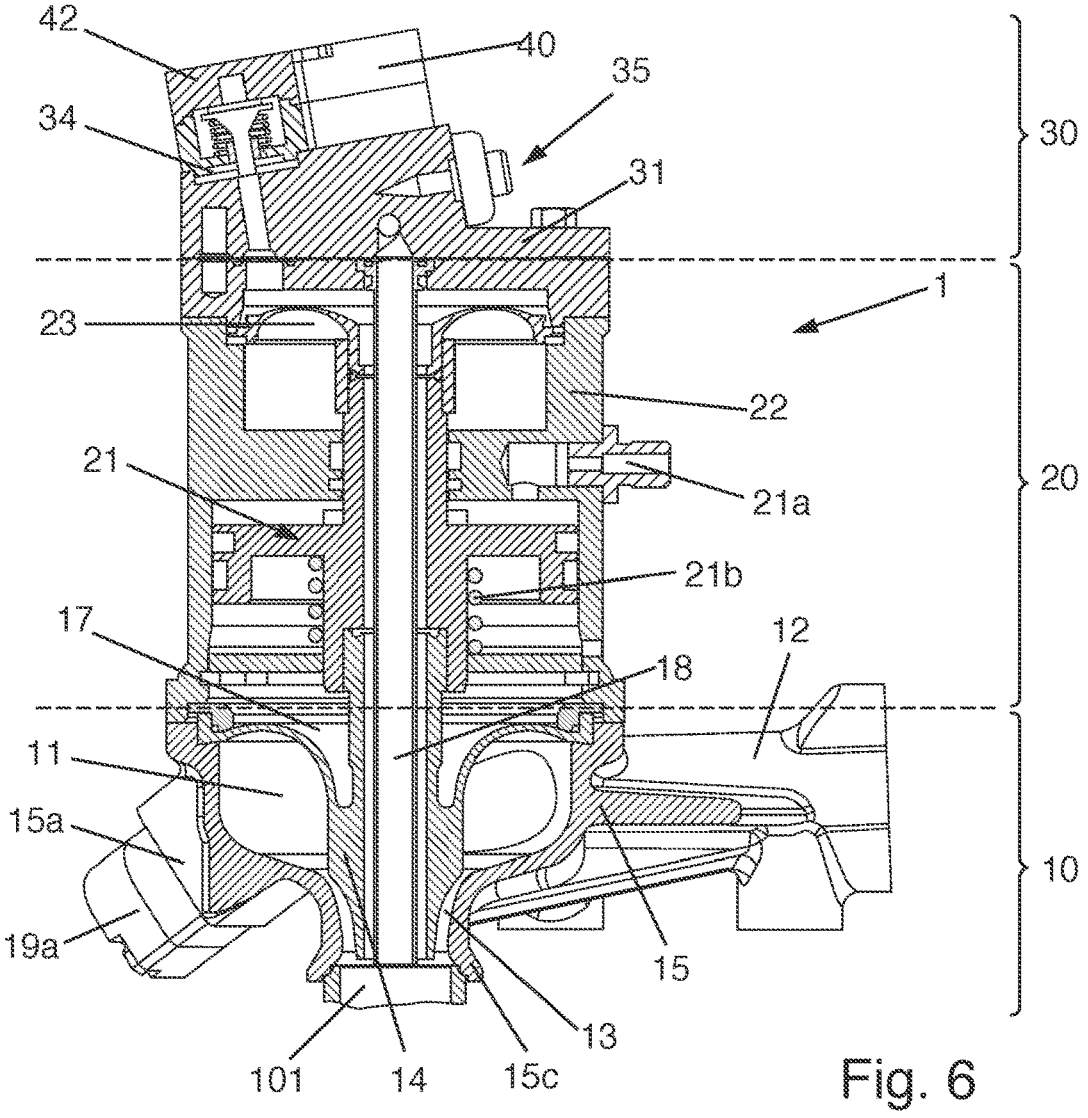
FIG. 6 shows a cross-sectional view of a filling valve with a valve base body according to FIGS. 3*a* and 3*b*, a valve central part with a valve cone drive and a valve head part with a valve carrier plate.

The tangential main inlet 12, set forth above, permits the upper face of the valve base body 10 to be unobstructed such that one or more modular valve components may be attached. Thus FIG. 6 shows in a cross-sectional view an exemplary filling valve 1, which has a valve base body 10 in the variant of FIGS. 3*a* and 3*b*, a valve central part 20 as a first modular valve component and a valve head part 30 as a second modular valve component.

The valve central part 20 is fastened via an interface to the valve housing 15 of the valve base body 10. In the exemplary embodiment of FIG. 6, the valve central part 20 has a valve cone drive 21 for actuating the valve cone 14. To this end, the valve cone drive 21 has an actuator which, for example, operates electromotively, magnetically, pneumatically or hydraulically. In the present example, the valve cone drive 21 has a media connection 21*a* via which a working medium, such as compressed air, may be supplied in order to actuate the valve cone 14. Moreover, the valve cone drive 21 has a spring 21*b*, which is generally configured as a spiral spring which serves to preload the valve cone 14 into a working position, for example the shut-off position or the fully open position.

According to this exemplary embodiment, the gas duct 18 provides separate gas paths via a pipe-in-pipe construction. The separation of the gas paths may be assisted at the interface between the valve central part 20 and the valve head part 30 by means of a membrane which is typically made of Teflon, so that these components may be connected in the valve head part 30 to the connections and/or interfaces described hereinafter.

Figure 6A:
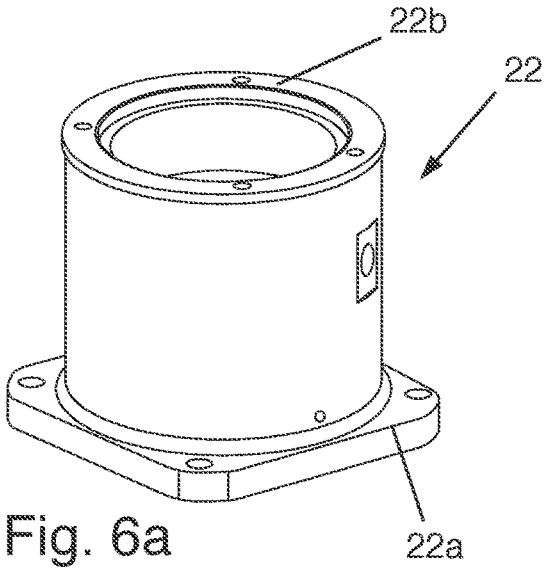
FIG. 6*a* shows a perspective view of the housing of the valve central part of FIG. 6.

The valve cone drive 21 is received in a cylindrical housing 22 which is designed for fastening to the valve base body 10 and to this end has one or more well-defined, typically standardized, interfaces. The housing 22 is shown separately in FIG. 6*a*. Moreover, a lower square flange portion 22*a* and an upper annular flange portion 22*b* are shown, by way of example said flange portions being interfaces for mounting the valve central part 20. By such a deliberate interruption to the symmetry it may be ensured that the valve central part 20 is always mounted in the correct position and orientation. The lower and upper flange portions 22*a*, 22*b* have in each case apertures by which screws, as fastening means, may be screwed in, whereby the valve base body 10 and the valve head part 30 may be screwed to the valve central part 20.

Figure 6B:
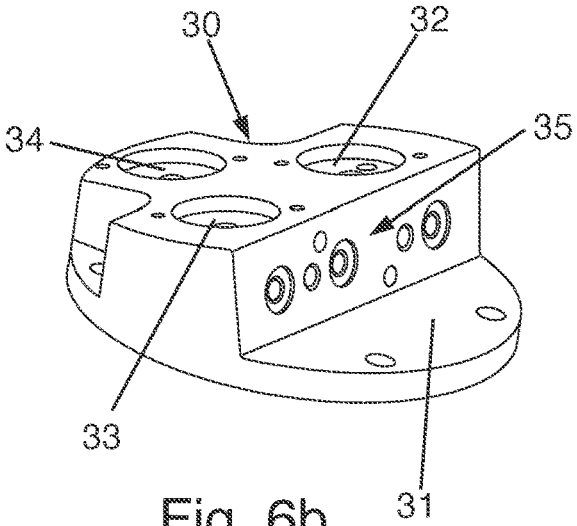
FIG. 6*b* shows a perspective view of the valve head part of FIG. 6.

The valve head part 30, which is shown separately in FIG. 6*b*, adjoins the filling valve 1 at the top and has a valve carrier plate 31 and different connections and/or interfaces which relate to the functionality of the filling valve 1.

The valve head part 30 is fastened to the valve central part 20 via the valve carrier plate 31. In this case, the valve head part 30, in particular the valve carrier plate 31 thereof, may be designed to be connected directly to the valve base body 10.

Figure 7A:
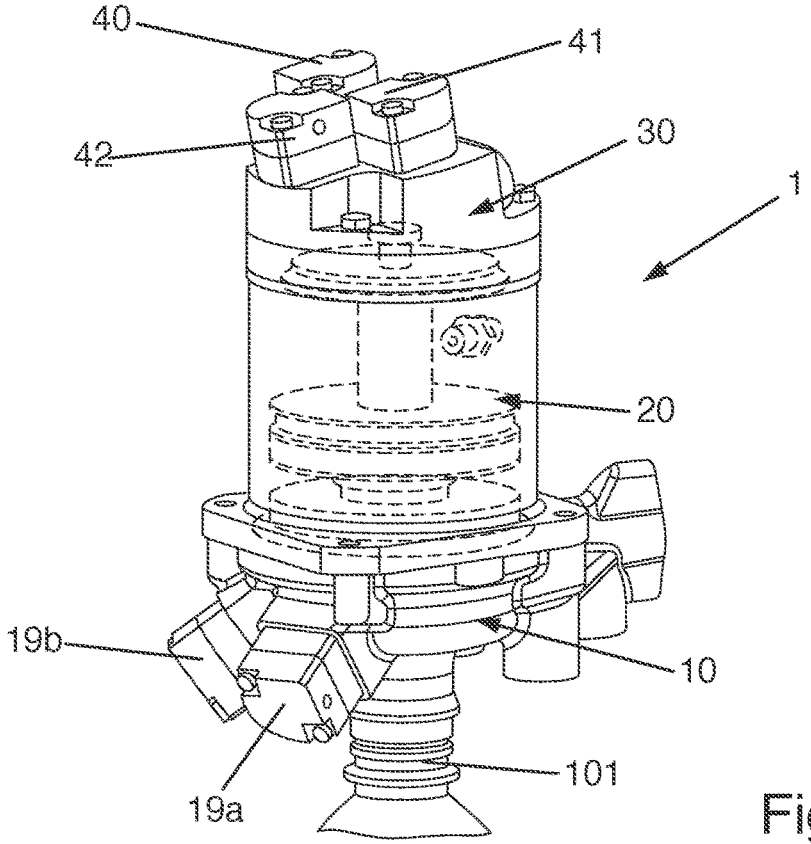
FIGS. 7*a* to 7*d* show perspective views of exemplary configurations of the filling valve.
Figure 7B:
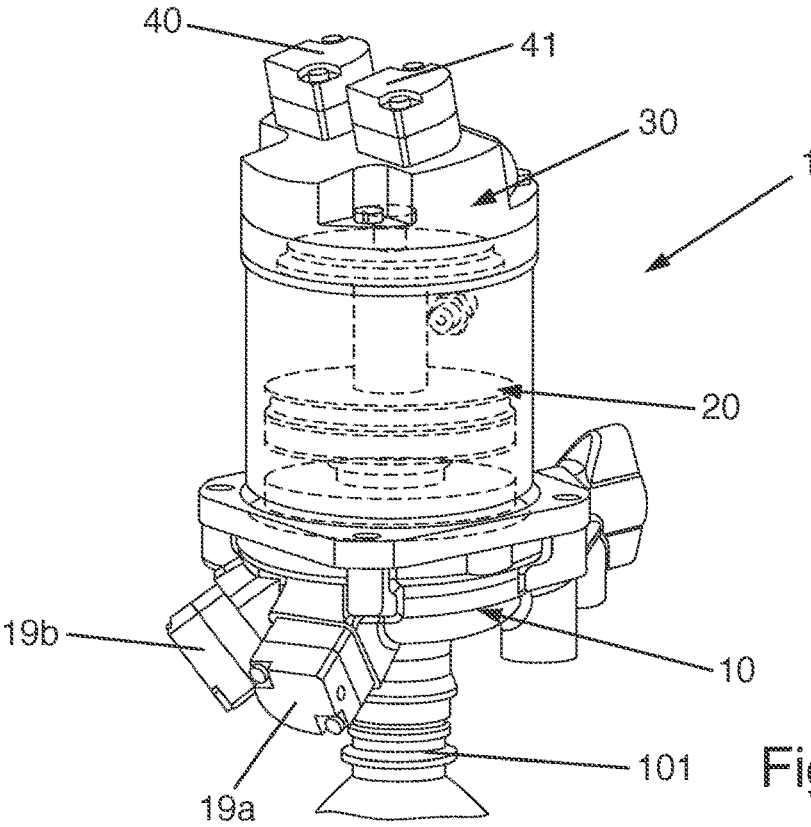
Figure 7C:
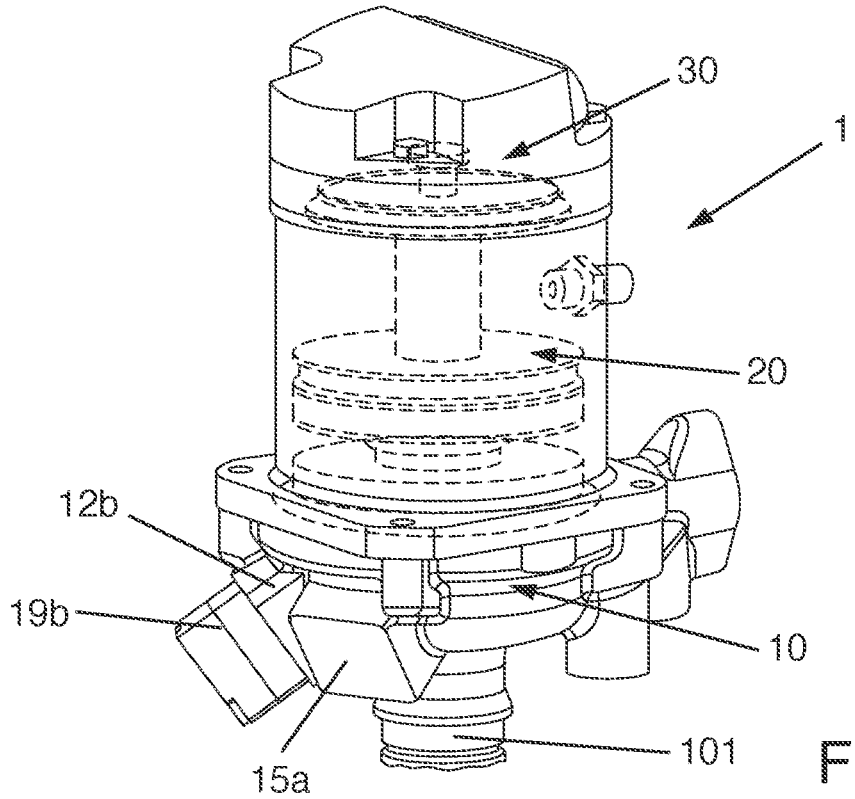

In the present exemplary embodiment, the valve head part 30 has a plurality of gas valve interfaces 32, 33 and 34, for example three thereof, which are designed for connecting gas valves 40, 41, 42 (see FIGS. 7*a*, 7*b* and 7*c*). The control of the gas valves 40, 41, 42 and the supply/discharge of gas are undertaken by corresponding supply connections 35.

FIGS. 7*a* to 7*d* show exemplary configurations of the filling valve 1. The formation of variants and/or differentiation for the specific application is implemented only later by the modular design, whereby costs and resources may be saved.

FIG. 7*a* shows the filling valve 1 with three gas valves 40, 41, 42 and two metering valves 19*a*, 19*b*. In this variant the filling valve 1 is suitable, for example, for filling beverages containing carbon dioxide, such as beer and CSD (carbonated soft drink). The gas valve 40 in this case serves as a prestressing valve in order to prestress the container 100 by means of a prestressing gas, generally carbon dioxide. The gas valve 41 serves for depressurizing the container 100; i.e. gas under an elevated pressure or gas displaced during filling, therefore, may be diverted in a controlled manner via the gas valve 41 from the container 100. For filling under negative pressure, removing flushing gas or the like, a negative pressure or vacuum may be generated in the container 100 via the gas valve 42. By evacuating the container 100 before filling, it is possible to reduce the quantity of oxygen in the container 100 and thus to counteract spoiling the product quality. The various gas supply and gas discharge functions are implemented via separate gas paths, for example by a pipe-in-pipe construction of the gas duct 18, as is shown in FIG. 6. In order to permit a highly flexible filling of customized beverages with or without short changeover times, the main component introduced via the main inlet 12 into the swirl chamber 11, for example water or juice, may be metered in addition to one or two metered components, for example syrup or pulp, via the metering valves 19*a*, 19*b* into the swirl chamber 11.

FIG. 7*b* shows the filling valve 1 with two gas valves 40, 41 and two metering valves 19*a*, 19*b*. In this variant, the filling valve 1 is suitable, for example, for filling water and soft drinks containing carbon dioxide (CSD). The gas valve 40 in this case serves as a prestressing valve in order to prestress the container 100 by means of a pressurized gas, generally carbon dioxide. The gas valve 41 serves for depressurizing the container 100; i.e. gas under an elevated pressure or gas displaced during filling, therefore, may be diverted in a controlled manner via the gas valve 41 from the container 100. The different gas supply and gas discharge functions are implemented via separate gas paths, for example via a pipe-in-pipe construction of the gas duct 18 as is shown in FIG. 6. In order to permit a highly flexible filling of customized beverages with or without short changeover times, the main component introduced via the main inlet 12 into the swirl chamber 11, for example water, may be metered in addition to one or two metered components, for example syrup, via the metering valves 19*a*, 19*b* into the swirl chamber 11.

FIG. 7*c* shows the filling valve 1 with the adjoining second secondary inlet 12*b* but without gas valves. A valve 19*b* is connected to the second secondary inlet 12*b*. In this variant, the filling valve 1 is suitable, for example, for the hot filling of juices. The main inlet 12 serves in this case as a hot intake whilst the second secondary inlet 12*b* with the connected valve 19*b* functions as a hot return. The gas duct 18 communicates, for example, with the external surroundings via the valve head part 30 and serves purely as a return duct, without the interposition of a gas valve. Separate gas paths are not necessarily required in this application.

Figure 7D:
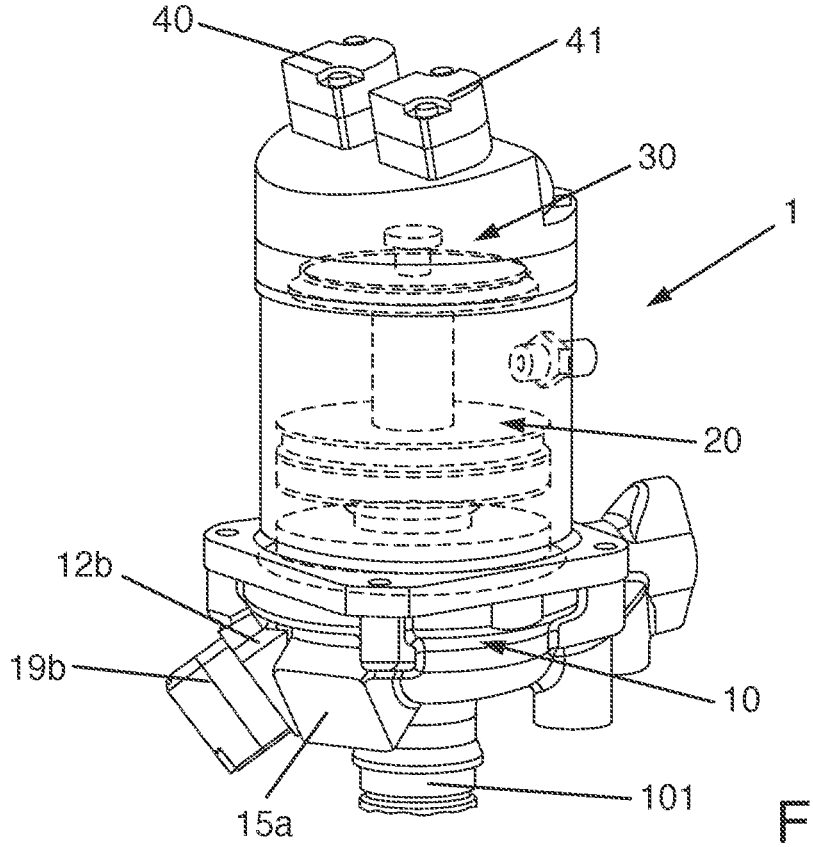

FIG. 7*d* shows the filling valve 1 with two gas valves 40, 41 and a connected second secondary inlet 12*b*. A valve 19*b* is connected to the second secondary inlet 12*b*. In this variant, the filling valve 1 is suitable, for example, for filling soft drinks containing carbon dioxide (CSD) and for the hot filling of juice. The main inlet 12 serves in the last case as a hot intake, whilst the second secondary inlet 12*b* with the connected valve 19*b* serves as a hot return. The gas valve 40 serves as a prestressing valve for prestressing the container 100 by means of a pressurized gas, generally carbon dioxide. The gas valve 41 serves for depressurizing the container 100; i.e. gas under elevated pressure or gas displaced during filling may, therefore, be diverted in a controlled manner via the gas valve 41 from the container 100. The different gas supply and gas discharge functions are implemented via separate gas paths, for example via a pipe-in-pipe construction of the gas duct 18, as is shown in FIG. 6.

Figure 8A:
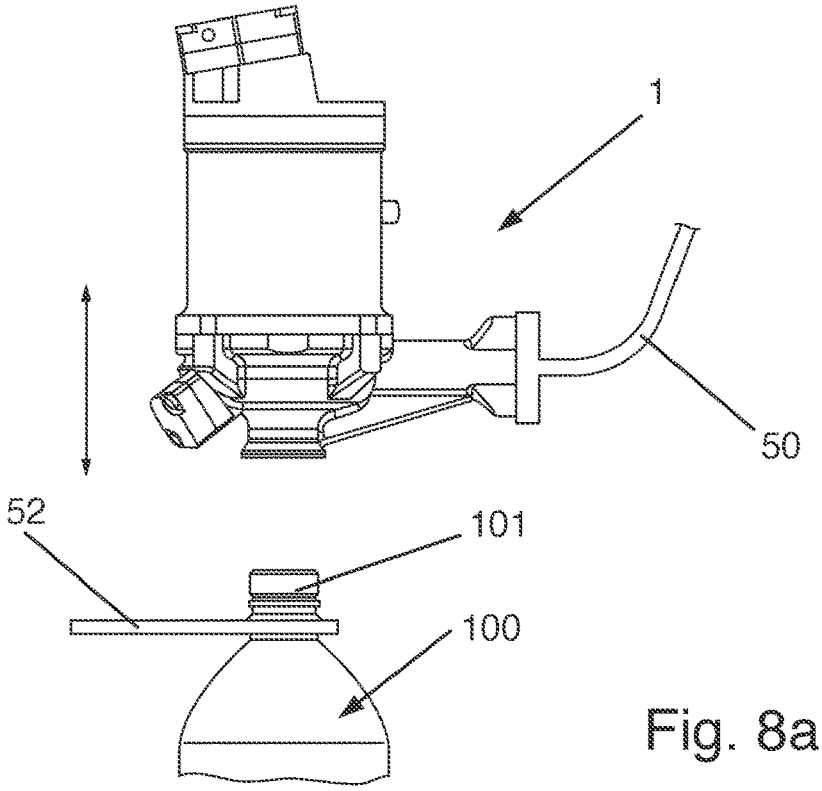
FIGS. 8*a* to 8*c* show exemplary uses of the filling valve relative to the container to be filled.
Figure 8B:
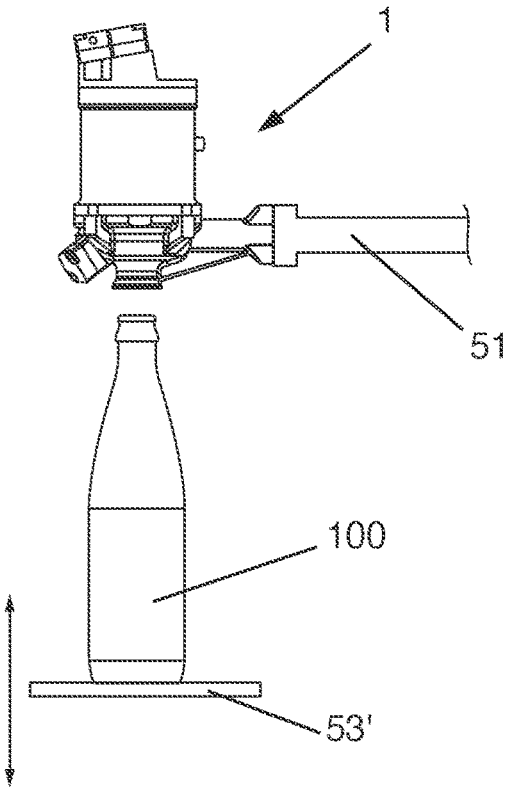
Figure 8C:
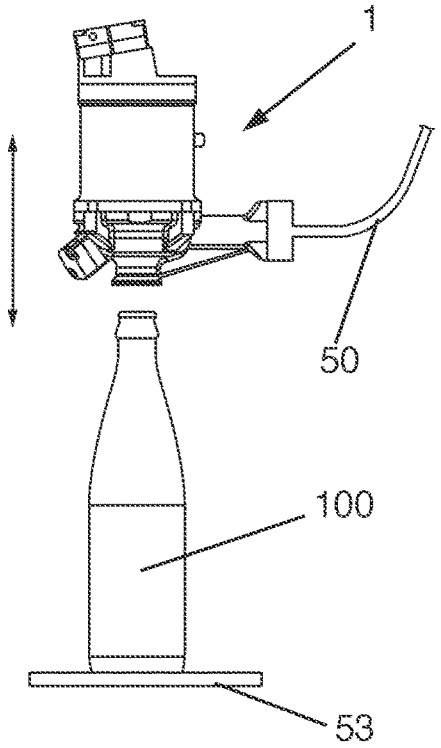

A further feature of the flexibilization set forth herein of the filling valve 1 relates to the handling thereof in relation to the container 100 to be filled. FIGS. 8*a* to 8*c* show different uses of the filling valve 1.

According to FIGS. 8*a* and 8*c* the filling valve 1 may be designed to be vertically movable. To this end, the main inlet 12 may be connected to a flexible product line 50. A filling valve 1 thus designed is used, for example, in the case of so-called "neck handling", as shown in FIG. 8*a*. In this case, the container 100 to be filled is held and transported by a holding device 52, for example a holding clamp on a transport star, by the neck and/or by the container opening 101. This type of handling is often used in the case of PET bottles. FIG. 8*c* also shows a vertically movable filling valve 1, wherein the container 100 is placed on a table-like container receiver 53. This type of handling is also denoted as "base handling" and is used, for example, with glass bottles. "Base handling" with a stationary filling valve 1 is shown in FIG. 8*b*. In this case the main inlet 12 may be connected to a rigid product line 51 since, for the filling process, the container 100 is moved by a vertically movable table-like container receiver 53' from below in the direction of the filling valve 1.

Figure 9A:
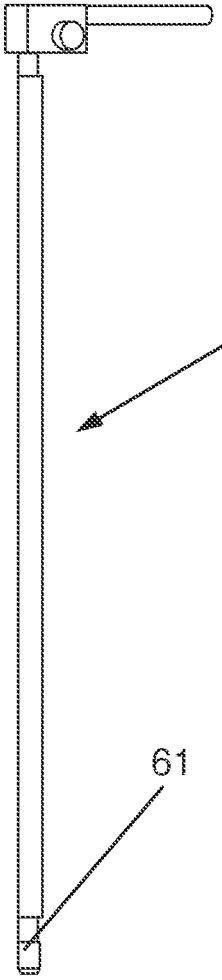
FIG. 9*a* shows a perspective view of the level probe of FIG. 9.
Figure 9:
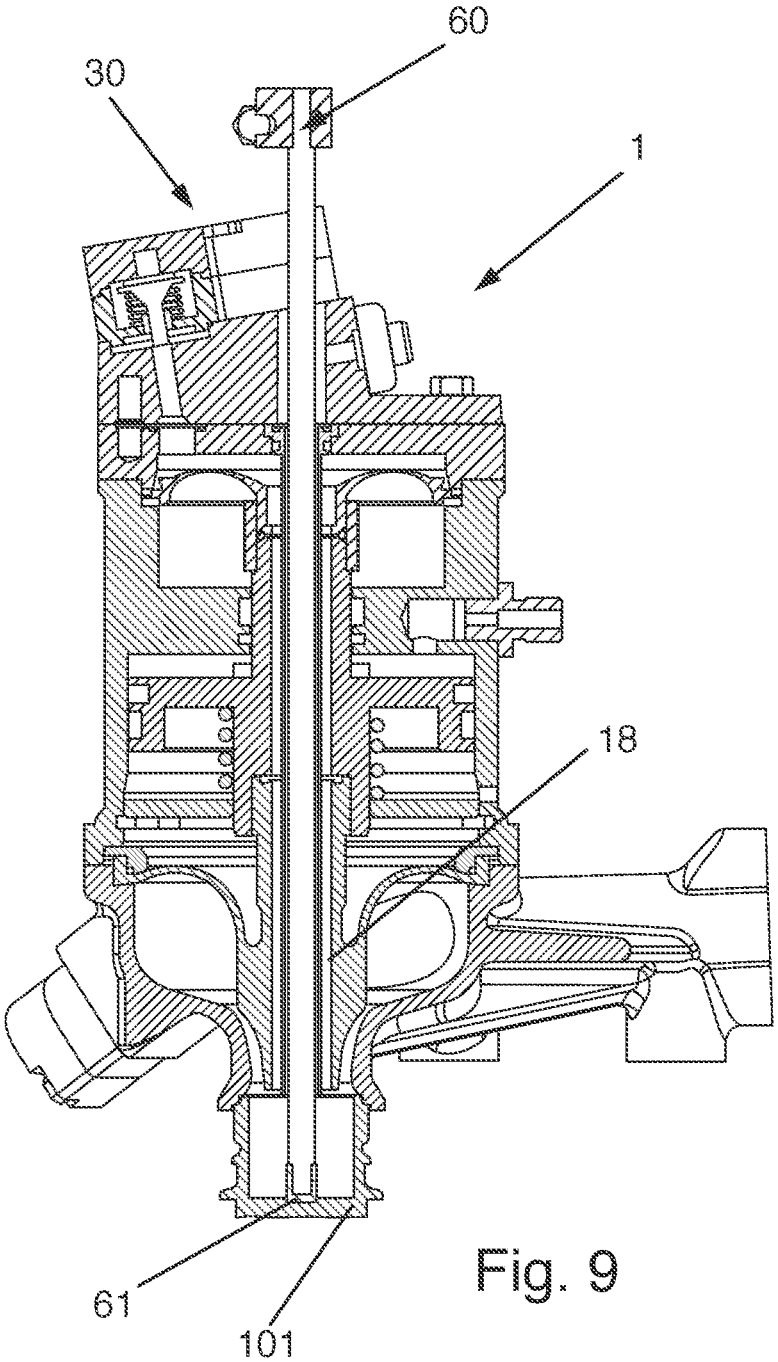
FIG. 9 shows a cross-sectional view of a filling valve with an inserted level probe.

The filling valve 1 is able to be provided with a level probe 60 as shown in FIGS. 9 and 9*a*. The level probe 60, see FIG. 9*a*, is of rod-shaped configuration with a sensor element 61 at one end of the rod. The level probe 60 is designed to detect a filling level of the filling product in the container 100, for example by wetting of the sensor element 61. To this end, the level probe 60 is inserted through the gas duct 18 until the sensor element 61 is located at a defined position in the container 100. A corresponding interface with an aperture for mounting the level probe 60 is configured in the valve head part 30.

The filling valve 1 set forth herein is particularly suitable for use in filling systems which are designed for flexible metering and instant product change by displacement to the rear. The filling product in this case is mixed together from a plurality of components, a main component such as water and at least one additional component such as syrup, directly in the swirl chamber 11 of the filling valve 1. In this case during the filling process, the additional components of the filling product are introduced via any potential metering valves 19*a*, 19*b* into the swirl chamber 11 and passed together into the container 100 to be filled. By introducing the additional components into the swirl chamber 11 the main component which was previously supplied through the main inlet 12 is displaced to the rear. The displaced volume of the main component is determined by means of a flowmeter and thus also the volume of the metered-in component(s) is known and controllable. During the subsequent filling of the filling product into the container 100, the main component together with the metered-in component is thoroughly flushed out of the filling valve 1 into the container 100, wherein at the same time the total filling quantity may be determined by the same flowmeter. During the next filling cycle, the filling quantities and also the metered component quantities may be determined again. Thus a highly flexible filling of customized beverages is possible, substantially without changeover times.

If applicable, all of the individual features which are shown in the exemplary embodiments may be combined together and/or replaced without departing from the scope of the invention.

The invention claimed is:

1. A filling valve for filling a container with a filling product comprising:

a valve base body, which comprises:

an outlet configured to discharge the filling product into the container;

a swirl chamber configured to receive the filling product and to be brought into a fluidic connection with the outlet; and a main inlet that feeds into the swirl chamber and is configured to introduce at least one component of the filling product into the swirl chamber such that the filling product is swirled in the swirl chamber, wherein the swirl chamber has an annular shape and a circular cross-section; and a valve cone, wherein the valve cone comprises a deformable material and/or is configured to be adjustable, and the swirl chamber extends substantially axially symmetrically about the valve cone.

2. The filling valve of claim 1, wherein the main inlet opens tangentially into the swirl chamber.

3. The filling valve of claim 1, wherein in a region of an opening of the swirl chamber, the main inlet has a cross-section that is substantially the same shape and diameter as the cross-section of the swirl chamber.

4. The filling valve of claim 1, wherein the outlet has an annular shape and the swirl chamber tapers towards the outlet.

5. The filling valve of claim 1, wherein the valve cone is configured to control flow of the filling product through the outlet in an axially displaceable manner.

6. The filling valve of claim 1, wherein the valve base body further comprises a valve seat, wherein the valve cone and the valve seat are configured such that the valve cone is in contact with the valve seat for sealing the outlet in a shut-off position.

7. The filling valve of claim 1, wherein the valve cone comprises a conical outlet that tapers towards the outlet and extends at least partially into the swirl chamber.

8. The filling valve of claim 1, wherein:

the valve base body further comprises one or more secondary inlets, and (i) the secondary inlets open into the swirl chamber and are correspondingly configured to introduce one or more additional components of the filling product into the swirl chamber, or (ii) the secondary inlets are coupled by apertures in or to a valve housing.

9. The filling valve of claim 1, wherein the valve base body further comprises a valve housing, which forms at least part of a wall defining the swirl chamber and the outlet.

10. The filling valve of claim 9, wherein:

the valve base body further comprises a membrane made of a second deformable material that forms part of a wall defining the swirl chamber, and (i) the membrane comprises an annular clamping portion that is configured to fasten the membrane to the valve housing, or (ii) the membrane is connected to the valve cone.

11. The filling valve of claim 10, wherein the valve housing comprises one or more interfaces on an outer face remote from the swirl chamber that are configured to connect a line or a metering valve to the valve housing.

12. The filling valve of claim 1, wherein the valve base body further comprises a gas duct that penetrates the valve cone in an axial direction.

13. The filling valve of claim 1, wherein the filling valve further comprises a valve cone drive that is mechanically connected to a connecting portion of the valve cone and is configured to actuate the valve cone.

14. The filling valve of claim 13, wherein the filling valve further comprises:

a valve central part that is connected to the valve base body; and a valve head part that is connected to the valve central part, wherein the valve central part comprises the valve cone drive.

15. The filling valve of claim 14, wherein the valve head part comprises one or more supply connections that are in fluidic communication with a gas duct and that provide an inlet and/or outlet for a gas.

16. The filling valve of claim 15, wherein the valve head part comprises one or more gas valve interfaces configured to connect a respective gas valve.

17. The filling valve of claim 1, further comprising a rod-shaped level probe configured to be inserted through a gas duct and to protrude in an inserted state into the container to detect a filling level of the filling product in the container.

18. A filling valve for filling a container with a filling product comprising:

a valve base body, which comprises:

an outlet configured to discharge the filling product into the container;

a swirl chamber configured to receive the filling product and to be brought into a fluidic connection with the outlet; and a main inlet that feeds into the swirl chamber and is configured to introduce at least one component of the filling product into the swirl chamber such that the filling product is swirled in the swirl chamber, wherein the swirl chamber comprises an annular duct and/or has a shape of a torus; and a valve cone, wherein the valve cone comprises a deformable material and/or is configured to be adjustable, and the swirl chamber extends substantially axially symmetrically about the valve cone.

* * * * *